United States Patent [19]

Miura et al.

[11] Patent Number: 4,962,840

[45] Date of Patent: Oct. 16, 1990

[54] CONTROL SYSTEM FOR CIGARETTE MAKING AND PACKAGING SYSTEM

[75] Inventors: Norimasa Miura; Yoshihisa Sato, both of Tokyo, Japan

[73] Assignee: Japan Tobacco Inc., Tokyo, Japan

[21] Appl. No.: 380,765

[22] Filed: Jul. 17, 1989

Related U.S. Application Data

[63] Continuation-in-part of Ser. No. 142,317, Dec. 30, 1987, abandoned, which is a continuation-in-part of Ser. No. 921,896, Oct. 24, 1986, abandoned, which is a continuation of Ser. No. 646,315, Aug. 30, 1984, abandoned.

[30] Foreign Application Priority Data

Sep. 2, 1983 [JP] Japan ..... 58-160253

[51] Int. Cl.[5] ..... B65G 1/00

[52] U.S. Cl. ..... 198/347.1; 198/572; 53/501; 53/148; 131/283

[58] Field of Search ..... 198/341, 347, 572; 131/282, 283, 909; 53/501, 148, 149, 151

[56] References Cited

U.S. PATENT DOCUMENTS

| | | | |
|---|---|---|---|
| 3,952,854 | 4/1976 | Selonke et al. | 198/347 |
| 4,149,545 | 4/1979 | Hall | 198/347 |
| 4,394,896 | 7/1983 | McComas et al. | 198/572 |
| 4,830,176 | 5/1989 | Hierons | 198/572 |
| 4,865,179 | 9/1989 | Carter et al. | 198/347 |

*Primary Examiner*—Joseph E. Valenza
*Attorney, Agent, or Firm*—Dvorak and Traub

[57] ABSTRACT

A control system for a cigarette making and pack aging system including a cigarette making machine, a cigarette packaging machine with a variable operation speed, and a reservoir mechanism provided between the cigarette making machine and the cigarette packaging machine, a current reserve amount calculating unit for calculating a current reserve amount in the reservoir mechanism, an intermediate reserve amount calculating unit for calculating an intermediate reserve amount, a desired value setting unit for setting a maximum reserve amount and a minimum reserve amount of the reservoir mechanism on the basis of the intermediate reserve amount, a comparison unit for comparing the current reserve amount with the maximum reserve amount and the minimum reserve amount, and a speed control unit for controlling the speed of the packaging machine on the basis of a comparison result by the comparison unit. The intermediate reserve amount is updated periodically with a predetermined period of time is such a way that a new value of the intermediate reserve amount for the following period of time is based on the average down time of the cigarette making machine and that of the cigarette packaging machine over the immediately preceding time interval, thus the minimum and maximum reserve amount at which the speed of the packaging machine is switched are automatically updated accordingly.

3 Claims, 9 Drawing Sheets

CONTROL SYSTEM FOR CIGARETTE MAKING AND PACKAGING SYSTEM

This application is a continuation-in-part of Ser. No. 07/142,317 filed Dec. 30, 1987 now abandoned which is a continuation-in-part of Ser. No. 06/921,896 filed Oct. 24, 1986 now abandoned which is a continuation of Ser. No. 06/646,315 filed Aug. 30, 1984 now abandoned.

BACKGROUND OF THE INVENTION

1. Field of the Invention

The present invention relates to a control system, particularly to a control system for cigarette making and packaging systems.

2. Prior Art

In a system in which a cigarette making machine is operatively combined with a cigarette packaging machine, stopping of one machine may cause stopping of the other machine, resulting in low working rate or operation efficiency of the entire system. Further, restarting of the system often involves some troubles, such as unacceptable product quality, before smooth operation of the system is again established.

U.S. Pat. No. 4,149,545 discloses one type of system in which two cigarette making machines are interconnected to a single cigarette packing machine via a transfer system which uses individual conveyors to convey the cigarettes from each cigarette making machine to a single chute leading to the packing machine.

A series of switches are disposed along the conveyor in the transfer system. These switches actuate a control to slow down or speed up the packing machine in response to the amount of stored cigarettes. The packing machine is operated at a reduced half speed or at a full speed. However, with this type of transfer system, the speed of the packing machine is varied when the present reserve amount increases to a value above a predetermined upper limit or decreases to a value below a predetermined lower limit so that the reservoir will not be emptied of the stored cigarettes. Since the upper and lower limits are of fixed values, the system is not free from the problem that stopping of the making machines or the packaging machine may cause stopping of the packaging machine or the making machine.

U.S. Pat. No. 4,394,896 discloses another type of backlog control system, wherein the system lends itself to the use of manual control settings which, when taken together, form an optimum control pattern or "curve". This curve can be set into the system so as to take into consideration a nominal or optimum processing machine speed, a preselected rate of article supply to the system, a minimum and a maximum backlog and a threshold or "plateau" count wherein the processing machine speed remains constant over preselected variations in the present reserve amount. These control settings are introduced into the system as simple article counts and can be displayed as such at the controls. In other words, by merely setting in preselected article counts and other required settings an operator can, in effect, draw a "tailor made" control curve which represents various critical stages in the control of processing machine speed. However, the nominal or optimum processing machine speed, the minimum and the maximum backlog and the threshold count remain the same unless the operator operates the controls again.

SUMMARY OF THE INVENTION

It is therefore an object of the present invention to provide a control system for a cigarette total operation efficiency thereof by automatically updating the nominal or optimum reserve amount of cigarettes in the reservoir for the following time interval on the basis of the average down time of both the cigarette making machine and cigarette packaging machine in the preceding time interval.

The reserve amount calculating means 23 calculates the current reserve amount in the reservoir taking the difference between the outputs of a first cigarette counting means which counts the number of cigarettes conveyed to the reservoir from the making machine and the output of a second cigarette counting means which counts the number of cigarettes conveyed to the packaging machine from the reservoir. An optimum reserve amount calculating means **24*a* calculates the operation efficiencies of the making and packaging machines on the basis of the average down time thereof over a preceding predetermined time interval. Then the optimum reserve amount calculating means 24*a* calculates an optimum reserve amount for the following time interval on the basis of the operating efficiencies over the preceding time interval. A desired value setting means 24 sets a maximum reserve amount which is a predetermined amount greater than the optimum reserve amount and a minimum reserve amount which is a predetermined amount smaller than the optimum reserve amount. The current reserve amount thus calculated is compared by a comparison means 25 with the maximum reserve amount or the minimum reserve amount. A speed control means 26** controls the drive source of the packaging machine in accordance with the output of the comparison means. The packaging machine is to be operated at a medium speed if the current reserve amount in the reservoir is between the maximum reserve amount and the minimum reserve amount. The packaging machine is to be operated at a high speed if the current reserve amount exceeds the maximum reserve amount and at a low speed if the current reserve amount is below the minimum reserve amount. Thus the minimum and maximum reserve amount at which the speed of the packaging machine is switched are automatically updated so that the current reserve amount is always "optimum" in accordance with the average down time of both the making and packaging machines. In other words, if the making machine tends to stop more often than the packaging machine, then the packaging machine is not switched to the high speed before the current reserve amount is sufficiently closer to the full state; if the packaging machine tends to stop more often than the making machine, then the packaging machine is not switched to the low speed before the current reserve amount is closer to the empty state.

BRIEF DESCRIPTION OF THE DRAWINGS

Features and details of the invention will be apparent from the following description of specific embodiments with reference to the accompanying drawings in which.

DETAILED DESCRIPTION OF THE PREFERRED EMBODIMENTS

Figure 2:
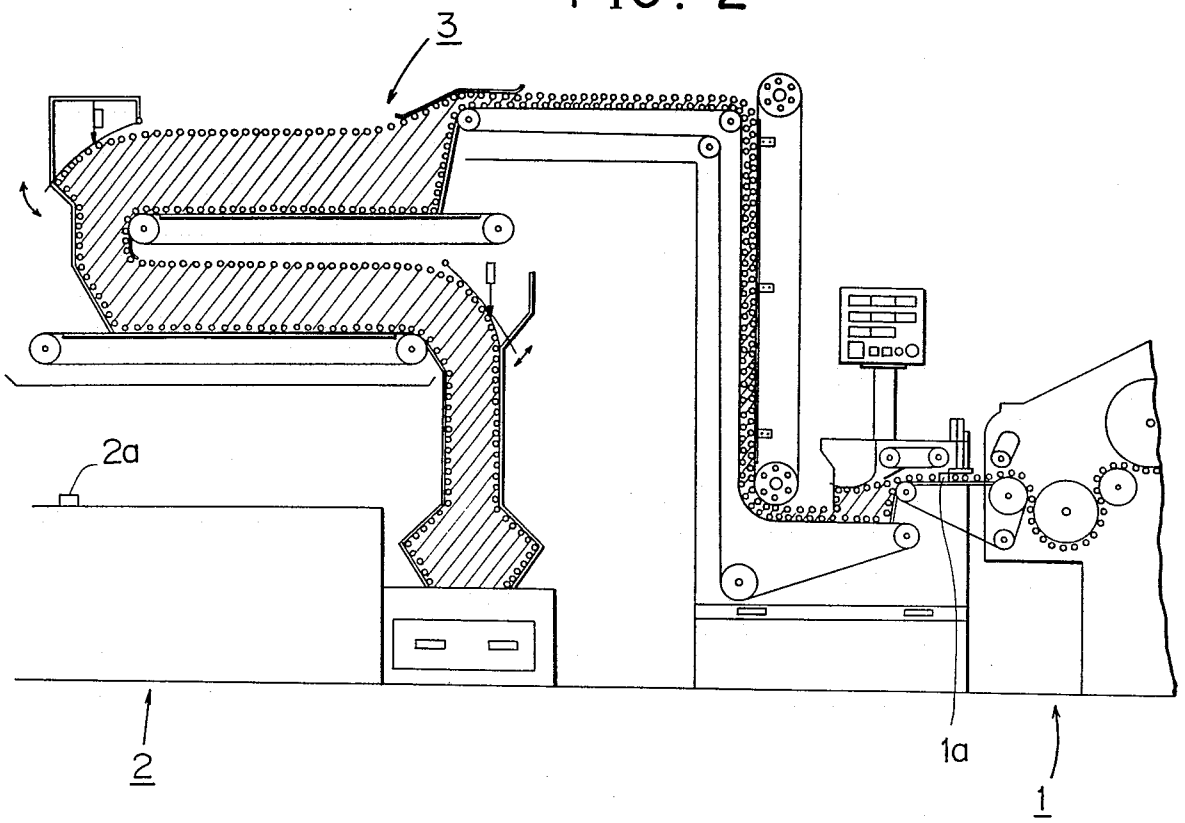
FIG. 2 is a sectional front view showing an embodiment of a cigarette making and packaging system which is controlled by a control system of the present invention.

Referring now to FIG. 2, a preferred embodiment will be described in detail. There is shown a cigarette making machine 1, a cigarette packaging machine 2, and a reservoir mechanism 3 which is provided between the cigarette making machine 1 and the cigarette packaging machine 2. The cigarette making machine produces paper-wrapped cigarettes at a constant rate and feeds the paper-wrapped cigarettes to the reservoir mechanism 3. The reservoir 3 is provided with an entrance for receiving the paper-wrapped cigarettes from the making machine 1 and an exist for feeding out the paper-wrapped cigarettes to the packaging machine 2. The reservoir mechanism 3 can be varied its storage capacity in accordance with the number of cigarettes coming into or going out of it but detailed description of which is not given since it is not directly related to the subject matter of the invention. The cigarettes packaging machine 2 may be operated at three steps of speeds, i.e., high, medium, and low speed, and is adapted to package twenty cigarettes in a single casing.

The making machine 1 is provided with a detector 1a, for example, a photoelectric tube to detect each one of the cigarettes conveyed to the reservoir mechanism 3, while the packaging machine is provided with a similar detector 2a, for example, a photoelectric tube to detect each one of casings in the vicinity of the exit of the packaging machine.

Figure 3:
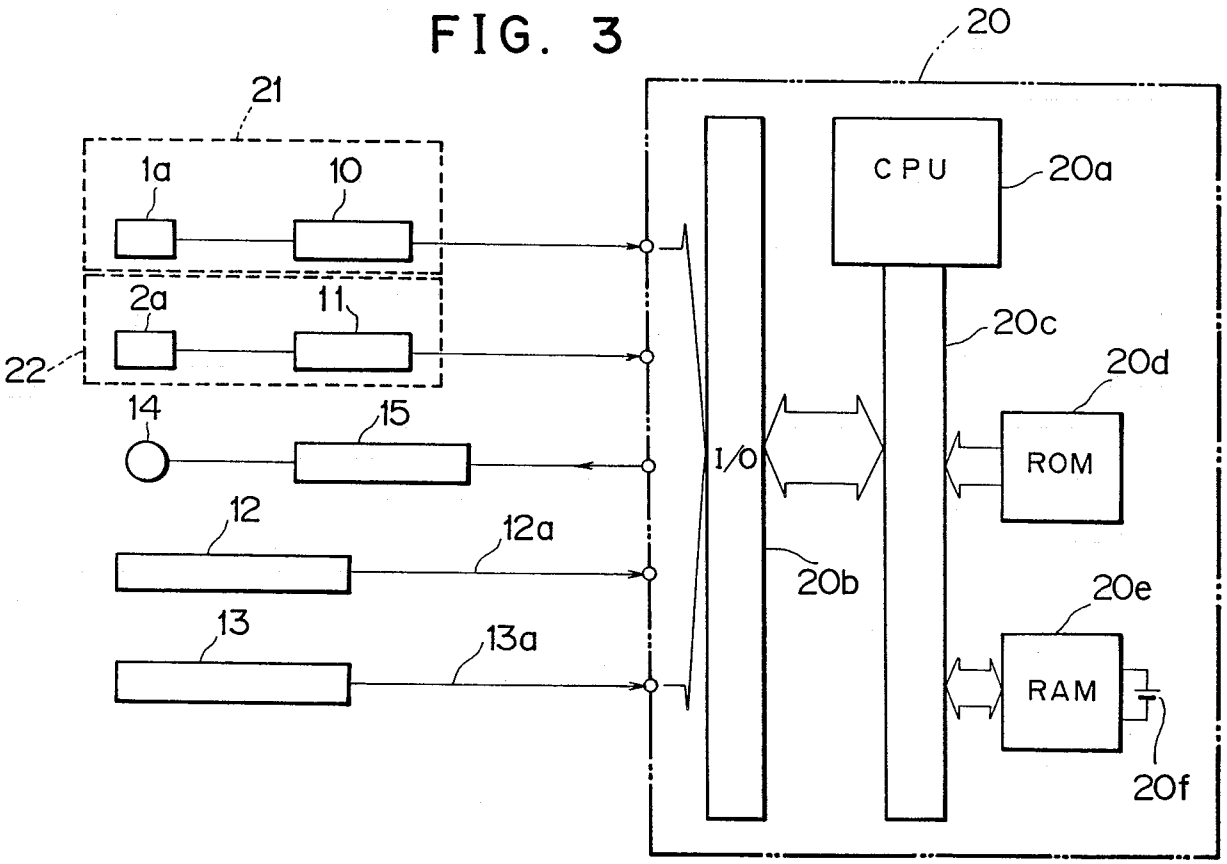
FIG. 3 is a schematic block diagram showing the central processing control device of the system of the present invention.

In FIG. 3, a divide-by-one-hundred counter, represented by the reference numeral 10, provides an output of a hundredth of its input frequency which is fed from the detector 1a. The counter 10 receives one pulse from the detector 1a every time the detector 1a detects one cigarette. The detector 1a and the counter 10 constitute a first cigarette counting means 21 in FIG. 1. The counter 10 provides at its output one pulse for every one hundred cigarettes detected. A counter 11 is a divide-by-five counter and has an input connected to the detector 2a. Accordingly the counter 11 receives one pulse generated at the output of the detector 2a every time the detector 2a detects one casing. The counter 11 generates one pulse at its output for every five casings detected.

Figure 1:
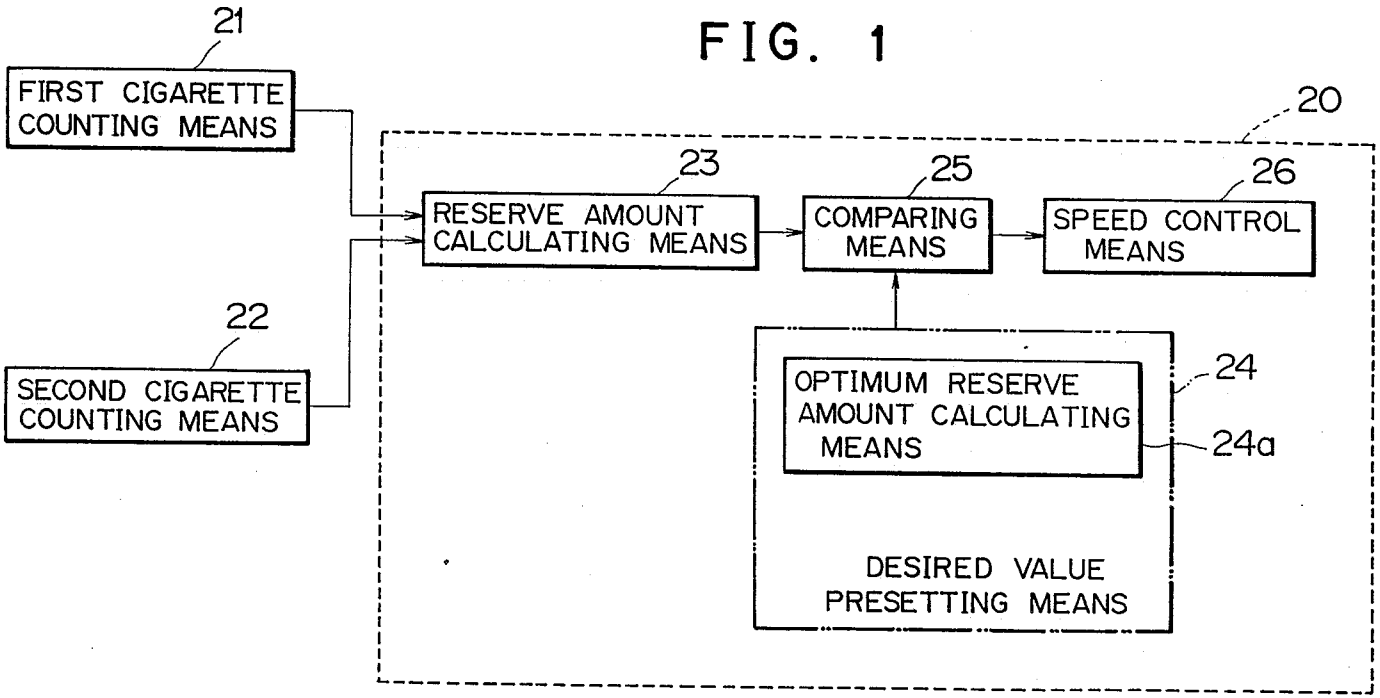
FIG. 1 is a schematic block diagram showing a basic structure of the present invention.

The detector 2a and the counter 11 form a second cigarette counting means 22 in FIG. 1. A reserve amount calculating means 23 calculates the current reserve amount X on the basis of the outputs from the first and second cigarettes counting means 21, 22.

A circuit 12 generates a making machine operation signal which may be a simple contact of a magnet switch of a motor to drive the making machine. A circuit 13 generates a packaging machine operation signal which may also be a simple contact. Each of the circuits 12, 13 provides a signal of two different levels, depending on whether the machine is operative or inoperative. A driving motor 14 may be operated at three speeds such as low, medium, and high speed under control of a motor control circuit 15.

As shown in FIG. 1, central processing control device 20 is adapted to carry out signal processing as the reserve amount calculating means 23, a comparing means 25, a speed control means 26, an optimum reserve amount calculating means 24a and a desired value presetting means 24, and to switch the speed of the motor 14 by controlling the circuit 15 in response to the signals from the counters 10, 11 and the circuits 12, 13. The central processing control device 20 comprises a central processing unit (CPU) 20a such as a microprocessor, input and output devices (I/O) 20b, a bus 20c, a read only memory (ROM) 20d, and a random access memory (RAM) 20e. FIG. 1 illustrates diagrammatically functions to be performed by these elements.

In the central processing control device 20, the CPU 20a executes various jobs, which will be described hereafter, in accordance with a program stored in the ROM 20d. The data required for the job and the data resulted from the job are stored in the RAM 20e. The RAM 20e is protected by a back-up power source 20f against power failure.

The first job to be executed by the CPU 20a is to determine the current reserve amount X of the cigarettes in the reservoir mechanism 3 by performing the calculation every time it receives the signals from the counters 10 and 11 via the I/O 20b and the bus 20c.

If the reservoir mechanism 3 already contains a certain number of cigarettes, which were reserved on, for example, the day before the calculation, then the RAM 20e must have stored therein that value. The calculation is performed taking the value in the RAM 20e into account. Thereafter the current reserve amount X may be calculated simply by adding the number of in-coming cigarettes to or subtracting the number of out-going cigarettes from the value stored in the RAM 20e. The number P of cigarettes per unit time coming into the reservoir mechanism 3 is determined by the first cigarette counting means 21.

The number Q of cigarettes per unit time going out from the reservoir mechanism 3 is determined by the second cigarettes counting means 22. The current reserve amount X in the reservoir mechanism 3 is calculated by a reserve amount calculating means 23 on the basis of the counts P and Q as follows.

$$X = Xo + P - Q \quad (1)$$

wherein Xo is the reserve amount of cigarettes already contained in the reservoir mechanism 3 before starting of the control, and value of which has been stored in the RAM 20e prior to the start of the system. There is a relation of P=Q, providing that both making machine and the packaging machine are operated at the same speed as well as both the machines are operating normally without stopping. It should be noted that the values of Q will be different if the speed of the packaging machine is changed.

Figure 4:
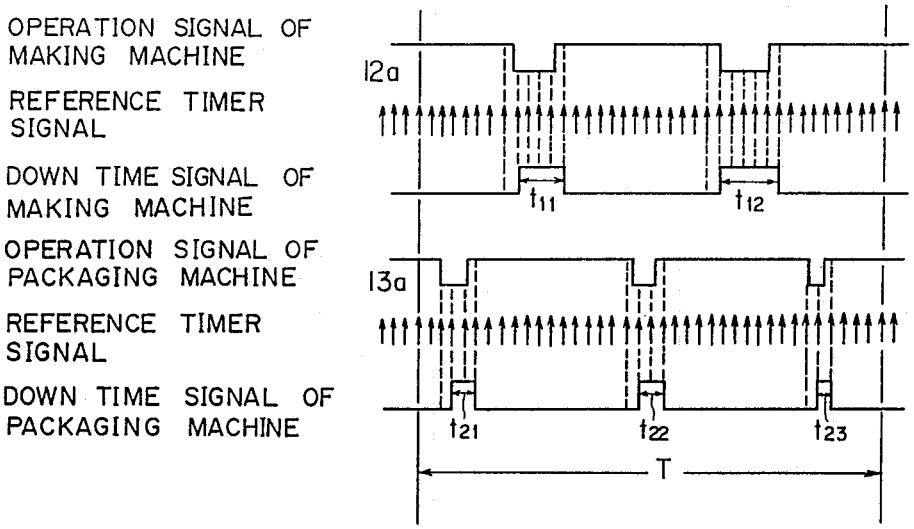
FIG. 4 is a diagram for explaining the principle for calculating the respective average down time in response to the operation signals from the respective machines.

CPU 20a receives operation signals 12a and 13a shown in FIG. 4 from the circuits 12 and 13, respectively, via the I/O 20b and the bus 20c. The down time of the making machine and the down time of the packaging machine are determined from the signals 12*a* and 13*a* to obtain the average values of the down time over a predetermined time period T as follows. Average down time of making machine:

$$t_\alpha = (1/m) \sum_{k=1}^{m} t1k \quad \text{Eq (2)}$$

Average down time of packaging machine:

$$t_\beta = (1/n) \sum_{k=1}^{n} t2k \quad \text{Eq (3)}$$

Efficiency of making machine:

$$\alpha = (T - t_\alpha \cdot m)/T \quad \text{Eq (4)}$$

Efficiency of packaging machine:

$$\beta = (T - t_\beta \cdot n)/T \quad \text{Eq (5)}$$

Wherein m and n represent the number of stops of the making machine and packaging machine, respectively and t1k and t2k are actual lengths of the down time of the making machine and the packaging machine, respectively.

In this specification, we use the term operation efficiency to refer to the ratio of the time for which the making machine actually contributes to making cigarettes within a predetermined time interval to the length of the predetermined time interval, and the ratio of the time for which the packaging machine actually contributes to packaging cigarettes within a predetermined time interval to the length of the predetermined time interval.

If the making machine tends to stop more often than the packaging machine, then the reservoir should reserve cigarettes more than a half of the full capacity of the reservoir while if the packaging machine tends to stop more often than the making machine, then the reservoir should reserve cigarettes less than a half of the full capacity of the reservoir.

Let's express the number of cigarettes in the reservoir by F for its full state, O for its empty state respectively, and assume that the number of cigarettes coming into the reservoir mechanism 3 over a predetermined time period is Po when the operation efficiency of the making machine is 100%, i.e., the making machine is not caused to stop, and the number of cigarettes exiting the reservoir mechanism 3 is Qo when the operation efficiency of the packaging machine is 100%, i.e., the packaging machine is not caused to stop. A required reserve amount y of the cigarettes to be reserved is calculated on the basis of the operation efficiency $\alpha$ of the making machine and the operation efficiency $\beta$ of the packaging machine as follows.

$$y = F \frac{Po \cdot \beta}{Po \cdot \beta + Qo \cdot \alpha} \quad \text{Eq (6a)}$$

There is the relation of Po=Qo, providing that both the making machine and packaging machine are operated at the same speed. Then Eq(6*a*) is reduced as follows.

$$y = F \frac{\beta}{(\beta + \alpha)} \quad \text{Eq (6b)}$$

Strictly speaking, Eq(6*b*) will not hold if the packaging machine is operated at a speed different from that of the making machine, which will be described later in detail, but time duration over which the packaging machine is operated at the different speed is rather short and therefore the above Eq(6*b*) will still hold in practice.

Let's say the operation efficiency of the making machine $\alpha$ is 0.9, and the operation efficiency of the packaging machine $\beta$ is 0.95, then $$y = F0.95/(0.95+0.9) = 0.51F \quad (6c)$$

Thus where the making machine goes "down" more frequently than the packaging machine, the reservoir tends to be empty; therefore y should be selected larger than a half of F for the reservoir not to be empty soon. Conversely, if the operation efficiency of the making machine $\alpha$ is, for example, 0.95, and the operation efficiency of the packaging machine $\beta$ is 0.9 then $$y = F0.9(0.9 = 0.95) = 0.49F \quad (6d)$$

Thus where the packaging machine goes "down" more frequently than the making machine, the reservoir tends to be full; therefore y should be selected smaller than a half of F for the reservoir not to become full soon.

The present invention assumes that a cigarette making machine operates at one fixed speed and a cigarette packaging machine operates at three different speeds, i.e., high, medium, and low, where the medium speed of the cigarette packaging machine is equal to the speed of the cigarette making machine. Eq(6*a*)–(6*d*) are based on the medium speed of the packaging machine.

Although the down time of the packaging machine and making machine can occur at any operating speeds of the packaging machine, high, or low or medium, there will be no significant changes in the values of y because it occurs at random in reality, and such a cigarette manufacturing system practically operates at an operating efficiency of, for example, 90% or better, and an actual down time of the cigarette making machine and packaging machine is only about three minutes or so in a 60 minute interval, often less than one minute at a time.

If the high speed and the low speed of the cigarette packaging machine are selected properly, then the cigarette packaging machine can quickly be brought back to the medium speed from either the high speed or the low speed; thus, the system can be regarded as being operating at the medium speed most of the time. Consequently, the operation efficiencies given by Eq(6*a*)–Eq(6*d*) would still be substantially accurate and useful even if the speed of the packaging machine changes for a short time.

The correction factors u1 and u2 can be applied to the value of operating efficiency $\alpha$ and $\beta$ to obtain y as shown by Eq(7) below if the system still has any problem with the aforementioned practical conditions.

$$y = F \frac{\beta \cdot u2}{(\alpha u1 + \beta u2)} \quad \text{Eq (7)}$$

When the reservoir mechanism becomes full or empty due to stoppage of either the making machine or the packaging machine, the other machine must stop. To avoid this inconvenience, margins are allowed and may be calculated by CPU 20a.

Margin y1 for one stop of the packaging machine when the reserve amount is increasing is calculated on the basis of the average down time $t_\beta$ of the packaging machine as follows.

$$y1=P.t_\beta \quad (8)$$

Margin y2 for one stop of the making machine when the reserve amount is decreasing is calculated on the basis of the average down time $t_\alpha$ of the making machine as follows.

$$y2=Q.t_\alpha \quad (9)$$

Figure 5A:
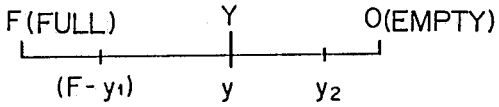
FIG. 5 is a diagram showing the relation between the optimum reserve amount and the margin against stoppage of the respective machines.
Figure 5B:
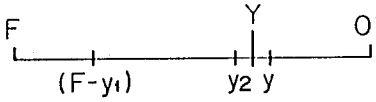
Figure 5C:
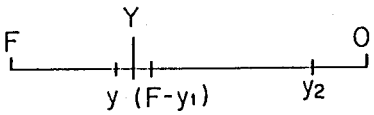

On the basis of the data y, y1, and y2, an optimum reserve amount Y is calculated as shown in FIG. 5 depending on the following conditions.

$$\text{If } (F-y1)\geqq y\geqq y2, \text{ then } Y=y \quad (10)$$

$$\text{If } y<y2, \text{ then } Y=(y+y2)/2 \quad (11)$$
$$\text{If } y>(F-y1), \text{ then } Y=\{y+(F-y1)\}/2, \quad (12)$$

It should be noted that the positions of (F−y1), y, y2 are different between the three cases in FIG. 5. This is because each case is based on different values of the operation efficiencies $\alpha$ and $\beta$.

A given value Z is stored into the central processing control device 20 in advance, and the CPU 20a presets the maximum reserve amount Y+Z and the minimum reserve amount Y−Z on the basis of Z and Y, where Z is an allowable deviation of the current reserve amount X from the optimum reserve amount Y before the speed of the packaging machine must be switched from the medium speed to the high or low speed and is stored in the RAM 20e before the control of the system. When the current reserve amount X is greater than Y+Z, the packaging machine is operated at the high speed; when the current reserve amount X is smaller than Y−Z, the packaging machine is operated at the low speed. Although the value of Z may be selected depending on the capacity of the reservoir, it is generally around 1000 to 2000 cigarettes in practice. The current reserve amount X is compared with the maximum reserve amount and the minimum reserve amount by the CPU 20a. The result of the comparison is outputted to the motor control circuit 15 via the bus 20c and the I/O 20b so that the driving motor 14 of the packaging machine is controlled its speed.

The control of the speed of the packaging machine is carried out as shown in FIG. 6.

If X≧Y+Z, then a high speed signal is generated and a high speed operation is carried out accordingly till X=Y, and then a medium speed signal is generated when X=Y. If X≦Y−Z, then a low speed signal is generated and a low speed operation is carried out till X=Y and then medium speed signal is generated when X=Y. If (Y+Z)>X>(Y−Z) and the packaging machine is being operated at the medium speed, then the medium speed signal remains.

At a low speed, the packaging machine is operated at a speed lower than the speed at which the making machine operates. Further at a medium speed, the packaging machine is operated at its medium speed, between its high speed and low speed during which the relation of P=Q is satisfied.

In other words, the optimum reserve amount Y is an intermediate reserve amount which lies between the maximum reserve amount and the minimum reserve amount value. Changing the value of the intermediate reserve amount causes the maximum and minimum reserve amounts to be shifted accordingly since Z is of a fixed value. Thus updating the value of Y according to the Eq(10)-(12) at the end of a predetermined time interval allows the reservoir to reserve an optimum amount of cigarettes for the subsequent time interval.

Figure 6A:
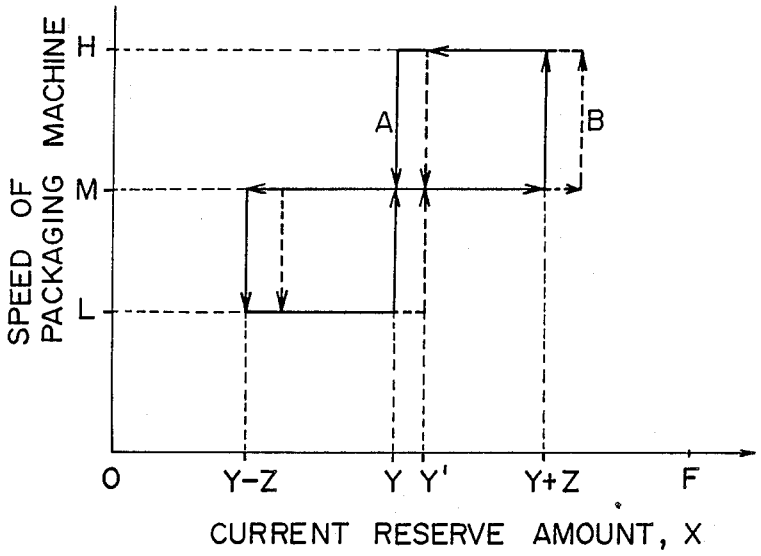
FIG. 6a–6b are diagrams for explaining the relation between the current optimum reserve amount and the corresponding speed of the packaging machine in a first and a second embodiment of the invention.

FIG. 7 to FIG. 10 illustrate the flowchart of the jobs which are executed by the CPU 20a in accordance with the program. FIG. 6a shows more diagrammatically the jobs described with reference to the flowcharts in FIG. 7 to FIG. 10. The making machine starts its operation as soon as the job starts. In the flowchart in FIG. 7, initialization is carried out when the job is started. At steps S1 and S2, decision is made based on whether X>Y+Z or X<Y−Z. At these steps, the values of X and Y, which are the last values in the previous operation of the system and stored in the RAM, are used. Based on the decision, operation speed of the packaging machine is set at steps S3, S4, and, S5. After the speed is set, a predetermined value of a time interval T, the accumulated down time t,$\alpha'$ of the making machine over the time interval T, the accumulated down time $t\beta'$ of the packaging machine over the time inverval T, the number m of stops of the making machine, the number n of stops of the packaging machine, and a speed-change memory Ms are all cleared to zero at step S6.

Figure 8:
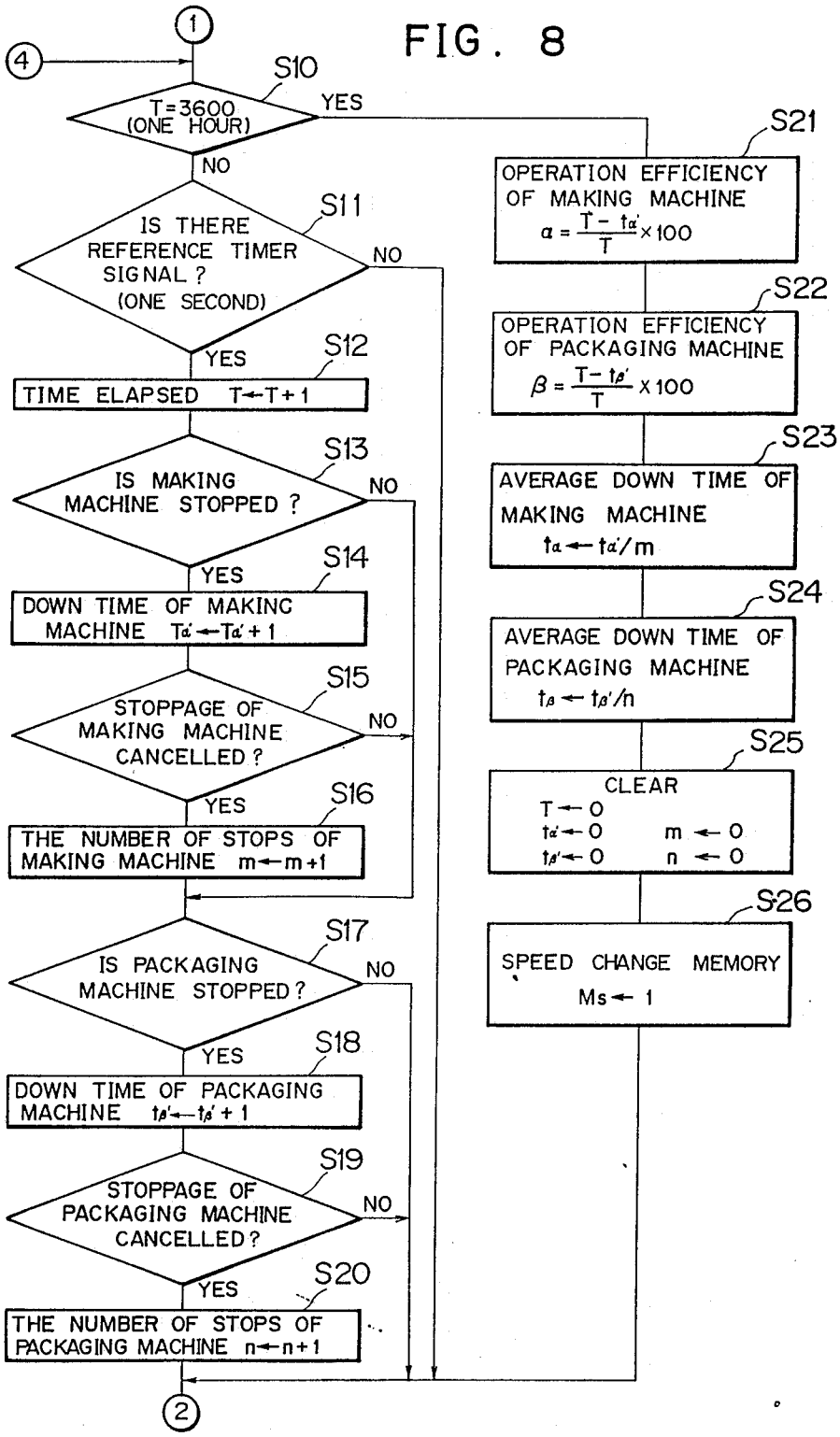

Thereafter the calculation shown in the flowchart of the FIG. 8 is carried out in response to the operation signals from the machines.

At step S10, decision is made based on whether or not the time T has elapsed an hour. If the time T has not elapsed one hour or 3600 seconds yet, then at step S11, a decision is made based on whether a reference timer signal is present or absent. The reference signal is a timing signal which interrogates the time elapsed T with a proper time interval, every second in this embodiment, the accumulated down time $t\alpha'$, $t\beta'$ and the numbers n and m of the down time of the packaging and making machines. If "NO" at S11, then the program proceeds to the step S30 for calculating the optimum reserve amount Y, which will be described in FIG. 9. If the timer signal is present, then one, i.e., one second, is added to the time T, at step S12. Thereafter, at step S13, decision is made based on whether or not the making machine is stopped. If stopped, the accumulated down time $t\alpha'$ is added one, i.e., one second, at step S14. At S15, decision is made based on whether or not the stoppage of the making machine has been canceled. If canceled, the number of stoppage m of the making machine is incremented by one at step s16.

If "NO" at S13 and S15, or upon completion of S16, the program proceeds to step 17 to make a decision based on whether or not the packaging machine is stopped. If stopped, then accumulated down time $t\beta'$ is added one at S18 i.e., one second, and then at S19, a decision is made based on whether or not the stoppage of the packaging machine has been canceled. If it has been canceled, then the number n of stoppage of the packaging machine is incremented by one at S20.

Figure 9:
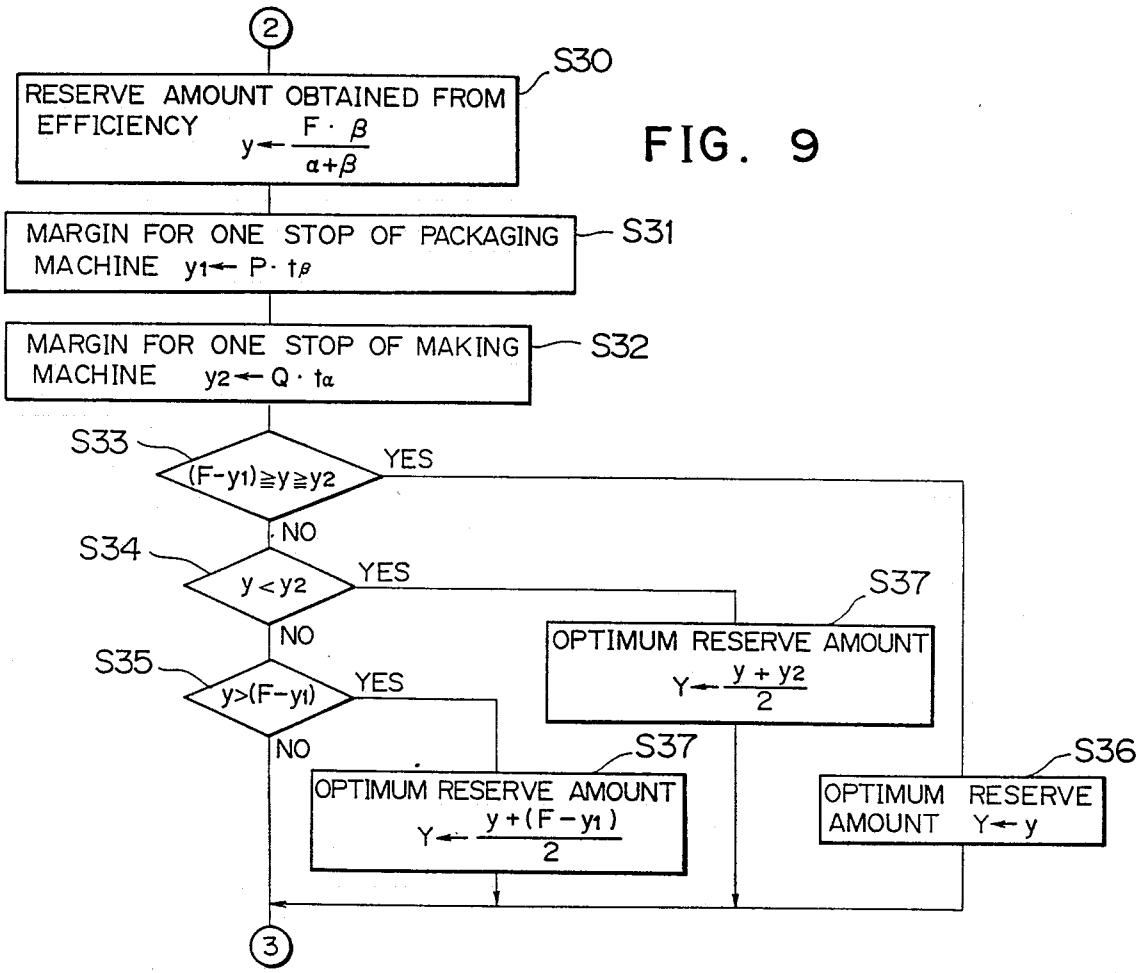
Figure 10:
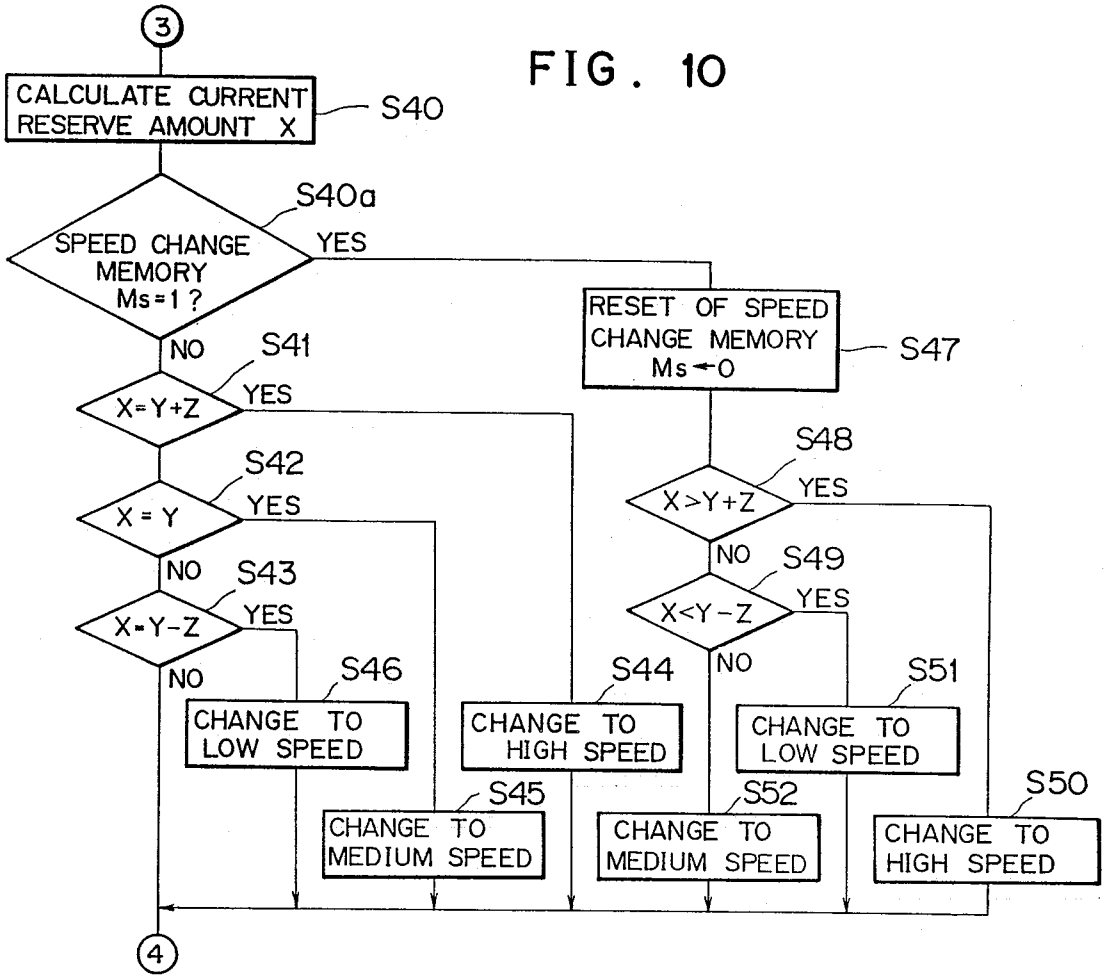

In the flowchart shown in FIG. 8, if the decisions in S11, S17, and S19 are "NO", or upon completion of S26, the program proceeds to the steps for calculating the optimum reserve amount Y shown in FIG. 9.

AT the first step S30 in FIG. 9, the reserve amount y is determined from the operation efficiencies $\alpha$ $\beta$. If the time T elapsed is less than one hour or 3600 seconds, then the last values of $\alpha$ and $\beta$ that have been stored in RAM 20*e* in previous operation of the system will be used.

Then a margin y1 for one stop of the packaging machine is determined at S31, and then S32, a margin y2 for one stop of the making machine. A decision is made based on whether or not $(F-y1)>y>y2$, $y<y2$, and $y>(F-y1)$ at S33 through S35. Then at S36 through S38, the optimum reserve amount Y is determined on the basis of the result of the above steps S33 through S35. After the optiumum reserve amount Y is determined, the program proceeds to the flowchart shown in FIG. 10 for determining the speed of the packaging machine.

At the first step S40, the present reserve amount X is calculated, and then, in S40*a*, a decision is made based on whether or not speed change memory Ms has been set, which memory Ms is to be set every hour. If Ms has been set, then the Ms is reset at S47 and the speed change is made at S48 through S52, which is the same as S1, S2, S3, S4 and S5 in FIG. 7.

If speed change memory Ms has not been set, then decision is made based on whether or not $X=Y+Z$, $X=Y$, or $X=Y-Z$ at S41, S42, and S43, respectively. If $X=Y+Z$, then the speed is set to the high speed at S44; and if $X=Y$ then to the medium speed at S45; if $X=Y-Z$ then to the low speed at S46.

Since the current reserve amount X of the reservoir varies much more slowly than the steps S10 through S52 are carried out, the content of the reservoir is in effect monitored substantially continuously; therefore execution of S10 through S52 can perform the speed-switching operation with hysteresis characteristics as shown in FIG. 6.

If the results in the above steps S41 through S43 are "NO", or upon completion of steps S44 through S46, then the program goes back to the step 10 in FIG. 8 and the above-mentioned steps are repeated.

If the time T is detected to have elapsed one hour or 3600 seconds at S10, then the operation efficiency $\alpha$ of the making machine, the operation efficiency $\beta$ of the packaging machine, average value $t\alpha$ of down time of the making machine, and the average value $t\beta$ of down time of the packaging machine are obtained at S21, S22, S23, and S24, respectively. Then, T, $t\alpha'$, $t\beta'$, m, and n are all cleared at S25, and the speed change memory Ms is set to one. At S30, 31, 32 new values of the reserve amounts y, y1 and y2 are calculated. Then new value of the optimum reserve amount Y is calculated at S36, 37, 38 on the basis of the operation efficiencies $\alpha$ and $\beta$ over the preceding one hour period. It should be noted that the control of the speed of the packaging machine is carried out with a hysteresis characteristics as shown in FIG. 6*a*, in which the packaging machine is switched to a new speed at a current reserve amount but is switched back to the previous speed at a different value of the current reserve amount.

Suppose that the cigarette making machine is making 8000 cigarettes per minute and the maximum reserve amount is set to a value of 1600 cigarettes greater than the optimum reserve amount. At this time, if the current reserve amount X increases to a value above the maximum reserve amount due to intermittent down time of the cigarette packaging machine over a one-hour period, then operating the packaging machine at a speed 10% higher than that of the cigarette making machine can bring the present reserve amount X of the reservoir back to the optimum reserve amount by only two minutes. On the other hand, suppose the minimum reserve amount is set to a value of 1600 cigarettes less than the optimum reserve amount. At this time, if the present reserve amount X decreases to a value below the minimum reserve amount due to intermittent down time of the cigarette making machine over a one-hour period, then operating the packaging machine at a speed 10% lower than that of the cigarette making machine can bring the present reserve amount X of the reservoir back to the optimum reserve amount by only two minutes.

The apparatus according to the present invention operates in such a way that the operation efficiencies $\alpha$ and $\beta$ in the preceding period, which are actually measured and calculated, are used in determining the new optimum reserve amount Y for the following period. The new optimum reserve amount updated or renewed at the end of the preceding period always causes cigarettes to be stored in the reservoir in such a way that a chance that stoppage of one of the two machines causes stoppage of the othr is decreased. That is, if the making machine tends to stop more often than the packaging machine, then the value of the optimum reserve amount Y will be closer to the full state F of the reservoir. If the packaging machine tends to stop more often than the making machine, then the value of the optimum reserve amount iwll be closer to the empty state 0 of the reservoir 3. Variation in the optimum reserve amount causes the maximum reserve amount $Y+Z$ and the minimum reserve amount $Y-Z$ to shift by an equal amount, thereby the speed of the packaging machine being switched at different values of the current reserve amount X so that the current reserve amount always tends to be optimum in accordance with the average down time of both the making and packaging machines.

In this manner, the reserve amount in the reservoir will converge in an optimum value with, for example, many one-hour periods. Once the entire system is started to operate, the average down time of the machines in a first one hour period can produce a new optimum reserve amount for the following one hour period. This new optimum reserve amount is a much more desirable value than that of the initial reserve amount. Then, the average down time in the following period will produce a further desirable new value of the optimum reserve amount and the old previous calcualation will be off. That is, an optimum reserve amount from past experience with the operation of the machines can be used as an initial value. Whether, the initial value of the optimum reserve amount is based on the same averages of the down time or different averages is not a problem.

Only one numerical value Z is preset in the above embodiment. However, multiple values, Z1, Z2, Z3, . . . Zn permits the mulltiple stages of controlling the system, in which case incremental or decremental speed with respect to the normal speed or medium speed can also be calcualted in accordance with the difference between the current reserve amount X and the optimum reserve amount Y, and is then converted to an analog voltage signal through D/A conversion, which in turn linearly controls the motor control circuit 15.

Figure 6B:
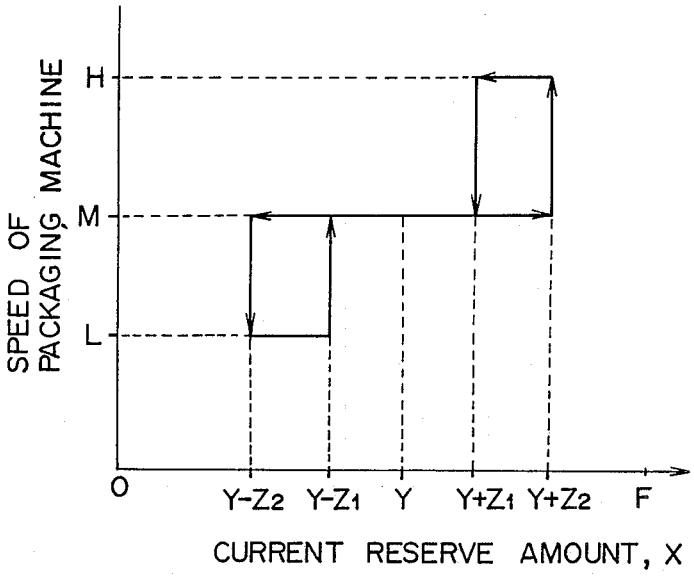
Figure 7:
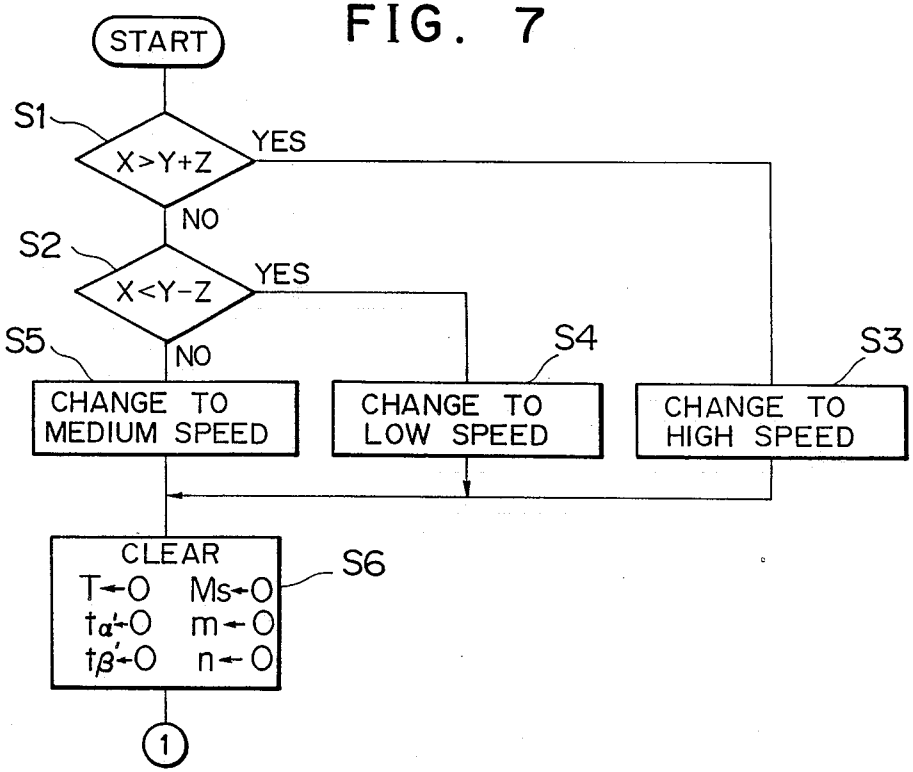
FIG. 7 to FIG. 10 are flowcharts for explaining the operation of one embodiment of the present invention.

FIG. 6*b* shows a second embodiment of the invention in which the multiple values, Z1 and Z2 are used.

What is claimed is:

1. A control system for a cigarette making and packaging system including a cigarette making machine, a cigarette packaging machine with a variable operation speed, and a reservoir mechanism provided between the cigarette making machine and the cigarette packaging machine, a current reserve amount calculating means for calculating a current reserve amount in said reservoir mechanism, an intermediate reserve amount calculating means for calculating an intermediate reserve amount, a desired value setting means for setting a maximum reserve amount and a minimum reserve amount of said reservoir mechanism on the basis of said intermediate reserve amount, a comparison means for comparing said current reserve amount with said maximum reserve amount and said minimum reserve amount, and a speed control means for controlling the speed of said packaging machine on the basis of a comparison result by said comparison means;

wherein said control system operates with hysteresis characteristics in which said operation speed of the cigarette packaging machine is switched from a low speed to a medium speed when the present reserve amount in said reservoir mechanism increass from a minimum reserve amount to an intermediate reserve amount;

said operation speed of the cigarette packaging machine is switched from the medium speed to a high speed when the present reserve amount in said reservoir mechanism increases from the intermediate reserve amount to a maximum reserve amount;

said operation speed of the cigarette packaging machine is switched from the high speed to the medium speed when the present reserve amount in said reservoir mechanism decreases from the maximum reserve amount to an intermediate reserve amount;

said operation speed of the cigarette packaging machine is switched from the medium speed to the low speed when the present reserve amount in said reservoir mechanism decreases from the intermediate reserve amount to the minimum reserve amount; and wherein said intermediate reserve amount is updated periodically with a predetermined period of time in such a way that a new value of said intermediate reserve amount for the following period of time is based on the average down time of said cigarette making machine and the average down time of said cigarette packaging machine over the immediately preceding period of time, said intermediate reserve amount being set to a lower value if the average down time of said cigarette packaging machine is greater than that of said cigarette making machine and set to a higher value if the average down time of said cigarette packaging machine is less than that of said cigarette making machine, while also said maximum reserve amount and said minimum reserve amount being updated by the same amount as said intermediate reserve amount is updated.

2. A control system for a cigarette making and packaging system according to claim 1, wherein said intermediate reserve amount is a single value between said minimum reserve amount and said maximum reserve amount.

3. A control system for a cigarette making and packaging system according to claim 1, wherein said intermediate reserve amount includes a first intermediate reserve amount and a second intermediate reserve amount between said minimum reserve amount and said maximum reserve amount, said first intermediate reserve amount being smaller than said second intermediate reserve amount;

said operation speed of the packaging machine is switched from the low speed to the medium speed at the first intermediate reserve amount when the current reserve amount in said reservoir mechanism increases from the minimum reserve amount to said first intermediate reserve amount; and said operation speed of the packaging machine is switched from the high speed to the medium speed at the second intermediate reserve amount when the present reserve amount in said reservoir mechanism decreases from the maximum reserve amount to said second intermediate reserve amount.

* * * * *